United States Patent [19]

Johansson et al.

[11] 4,136,635

[45] Jan. 30, 1979

[54] APPARATUS FOR CONTINUOUSLY COATING A WEB WITH A LIQUID

[75] Inventors: Erik V. Johansson; Mats O. Kullander, both of Säffle, Sweden

[73] Assignee: Billeruds Aktiebolag, Säffle, Sweden

[21] Appl. No.: 814,728

[22] Filed: Jul. 11, 1977

Related U.S. Application Data

[63] Continuation of Ser. No. 677,289, Apr. 15, 1976, abandoned.

[30] Foreign Application Priority Data

Apr. 28, 1975 [SE] Sweden ..... 7504872

[51] Int. Cl.[2] ..... B05C 1/08

[52] U.S. Cl. ..... 118/50; 118/261

[58] Field of Search ..... 427/296, 294; 118/50, 118/258, 261; 68/202; 354/318

[56] References Cited

U.S. PATENT DOCUMENTS

| | | | |
|---|---|---|---|
| 1,213,728 | 1/1917 | Beach | 118/235 |
| 2,141,978 | 12/1938 | Greenhill | 118/50 X |
| 2,354,033 | 7/1944 | McGladrey et al. | 118/50 X |
| 2,470,093 | 5/1949 | Crowder et al. | 118/261 |
| 3,461,837 | 8/1969 | Dreher | 118/50 |
| 3,474,757 | 10/1969 | Dreher | 118/411 |
| 3,827,397 | 8/1974 | Hebberling et al. | 118/50 |
| 3,940,782 | 2/1976 | Neeb et al. | 118/261 X |

FOREIGN PATENT DOCUMENTS

| | | | |
|---|---|---|---|
| 1577767 | 6/1969 | Fed. Rep. of Germany | 118/261 |
| 1577769 | 6/1969 | Fed. Rep. of Germany | 118/261 |

*Primary Examiner*—John McIntosh

*Attorney, Agent, or Firm*—Burns, Doane, Swecker & Mathis

[57] ABSTRACT

A chamber having an opening in its wall contains a roller. A portion of the surface of the roller is situated in the opening. A web is continuously moved past the chamber so as to cover the opening. A vacuum is created in the chamber. The external pressure forces the web into contact with the roller. A coating liquid is supplied into the chamber so as to wet the roller. The roller is rotated so that the coating liquid is transferred to the web.

2 Claims, 6 Drawing Figures

APPARATUS FOR CONTINUOUSLY COATING A WEB WITH A LIQUID

This is a continuation of application Ser. No. 677,289, filed Apr. 15, 1976, now abandoned.

The present invention relates to coating a web, preferably a paper web, with a controlled quantity of a liquid or a semi-fluid composition. It is an object of the invention to provide a method and an apparatus in which the coating liquid is uniformly distributed over the surface of the web. It is another object of the invention to provide a method and an apparatus for distributing a very small quantity of coating layer per unit area of the web. The invention is mainly but not exclusively concerned with coating a web with a release agent, so as to make the surface of the web non-sticky for various purposes.

The apparatus of the invention comprises providing a chamber having an opening in its wall, providing a roller in said chamber so that a portion of the surface of the roller is situated in said opening and spaced from the edge of the opening in the wall of the chamber which is downstream from said roller, continuously passing the web past said chamber while covering said opening, creating a vacuum in said chamber to suck the web into contact with the roller, supplying coating liquid into the chamber to wet the surface of the roller, and rotating the roller to convey coating liquid to the web.

The web is pressed against the roller by the air-pressure outside the chamber. In this way a uniform contact between web and roller is ensured, even if the roller is not quite straight. In order to provide a compact apparatus we prefer to use a roller having a diameter of a few centimeters only. When used for coating a paper web the roller may have a length of up to a few meters. This means that such a roller will be long and slender, the ratio of length to diameter being, say, 100:1, In order to prevent such a slender roller from bending, it is preferred to make it float on the coating liquid. The roller has to be constructed with a density lower than that of the coating liquid. It is preferred that the density be lower than that of water. This can be achieved by constructing the roller of a light-weight material, or by making it like a hollow cylinder with closing ends.

In the coating of a paper web, the external atmospheric pressure, which, as will be obvious from the accompanying drawings to be discussed more fully below, is greater than the pressure in the vacuum chamber, is also useful in preventing the coating liquid from being pressed out through the pinholes or pores in the paper. In other words, as will be further apparent from the drawings and from general considerations of the difference between the external atmospheric pressure and the vacuum in the coating chamber, the external atmospheric pressure on the back of the coated paper web and exposure of the coated side of the vacuum downstream from the roller will serve to prevent the coating from penetrating deeper into the paper. Since the method of the invention is a coating method, it is usually not desired that the coating liquid shall be absorbed by the paper.

The invention will now be described with reference to drawings.

Figures 1, 2, 3, 4, 5:
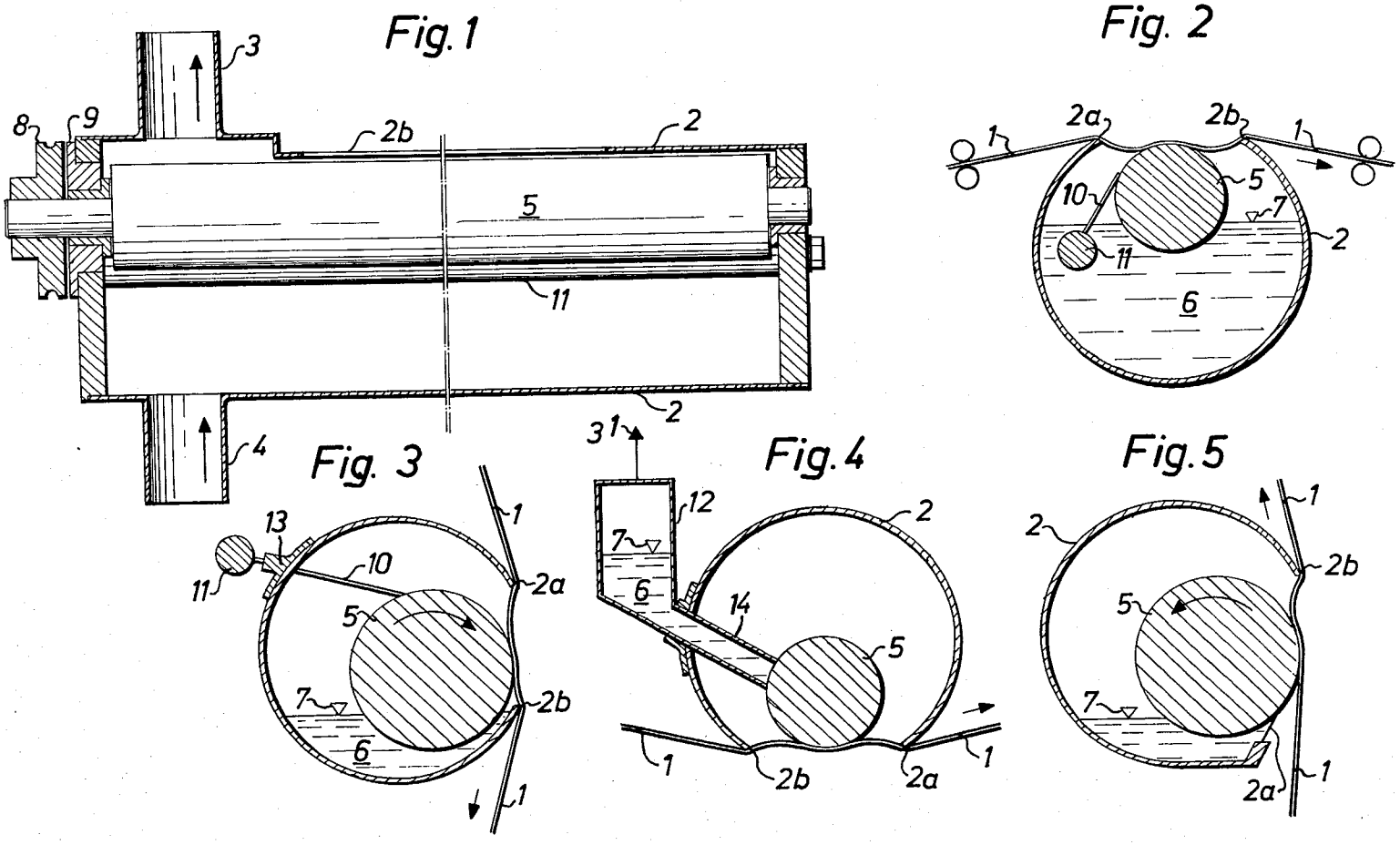
FIG. 1 shows a longitudinal section through an apparatus of the invention.
FIG. 2 shows a cross-section of the apparatus of FIG. 1.
FIGS. 3, 4 and 5 show cross-sections of three other embodiments.

According to FIGS. 1 and 2 a paper web 1 is passed over a vacuum chamber 2 provided with an opening having edges 2a and 2b. The web slides over the opening and is pressed against the edges 2a and 2b by the external air pressure. A vacuum is maintained in the chamber through a pipe 3. Coating liquid is supplied to the chamber through a pipe 4. A roller 5 is mounted in the chamber, the upper surface of the roller being located in the opening between the edges *2a* and *2b*. The external over-pressure forces the web against the surface of the roller. The roller is rotated by means of a belt pulley 8 and can be taken out and replaced after removal of the belt pulley 8 and a bearing plug 9. A scraper 10 is mounted in a holder 11 which can be externally operated. The scraper is placed to be in contact with the roller. It prevents liquid from splashing from the pool 6 of liquid in the chamber to the web. It also removes any excess of liquid adhering to the surface of the roller.

The pool 6 of liquid in the chamber shall have its surface 7 so high as to wet the roller 5. The surface 7 may easily be kept at a constant level by known means, not illustrated in the drawings. For example, a float in the chamber 2 may be arranged to actuate a valve in the liquid supply pipe 4 so as to supply the quantity of liquid required for keeping the level of the surface 7 constant.

FIG. 3 shows a cross-section of an embodiment suitable for vertical movement of the web. The scraper 10 is here inserted through the wall of the vacuum chamber, sealed by means of strips 13 of rubber.

FIG. 4 shows a cross-section of an embodiment suitable for coating the upper surface of a horizontally moving web. The coating liquid is supplied from a closed container 12 through a conduit consisting of two parallel walls 14 which extend to the surface of the roller 5. The container is connected to a vacuum pump through a conduit 3'.

FIG. 5 shows a cross-section of an embodiment which is suitable in special cases for vertical movement of the web. The edge 2a is in the shape of a scraper blade which is pressed by the external overpressure against the roller 5.

EXAMPLE

The apparatus disclosed in FIGS. 1 and 2 was used for coating a paper web with chromium stearate, which is a useful release agent. The chromium stearate was added as a 6% by weight solution. The opening in the chamber had a width of 60 mm. The roller had a diameter of 40 mm, and its upper surface was situated 1 mm below the edges of the opening. The paper web to be coated had a width of 1000 mm, and it was moved at a speed of 2 meters per second.

Two paper qualities were coated, viz. (A) unbleached kraft paper having a weight of 80 grams per $m^2$ and a surface roughness of 900 (according to Bendtsen), and (B) bleached machine-glazed paper having a weight of 80 grams per $m^2$ and a surface roughness of 100 (according to Bendtsen). The letters A and B in FIG. 6 relate to these two paper qualities.

The vacuum in the chamber corresponded to 200, 400 or 600 mm of water. The legend A200, for example, in FIG. 6 indicates that paper of quality A was coated at a vacuum of 200 mm of water.

Figure 6:
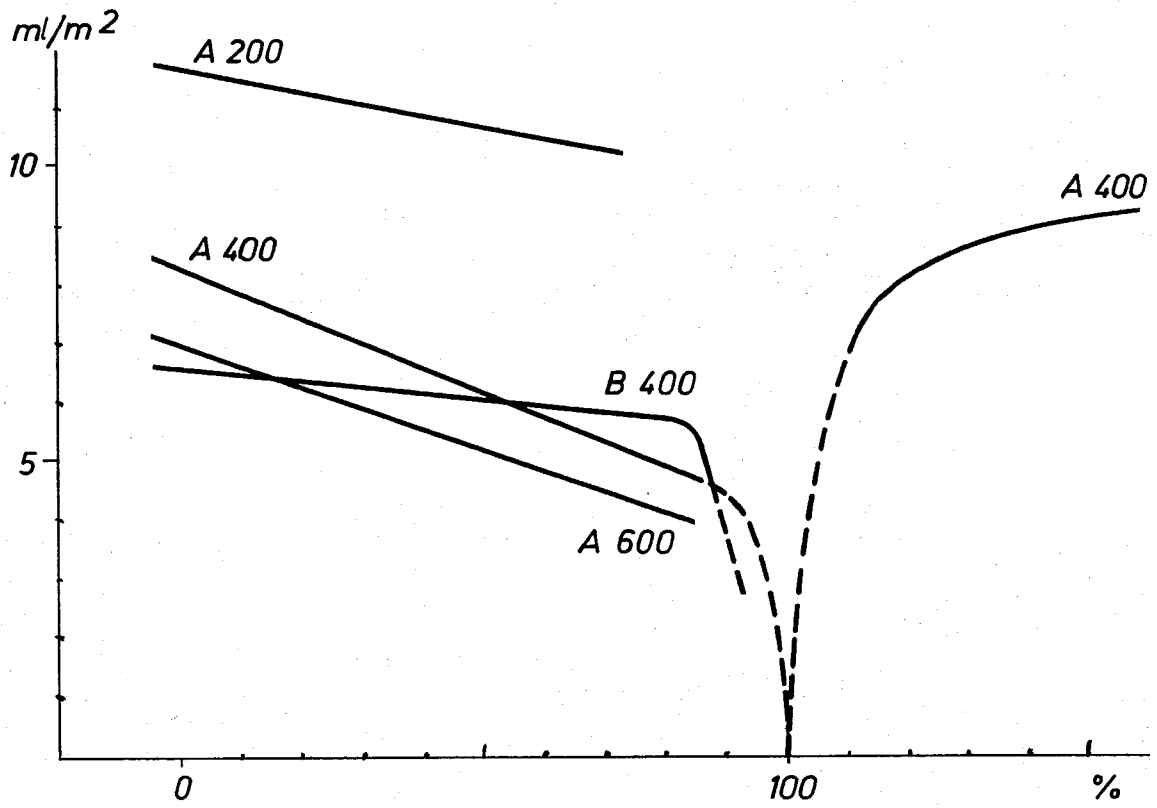
FIG. 6 is a diagram illustrating the result of the invention.

The velocity and direction of rotation of the roller was varied in this example. The abscissa of the diagram in FIG. 6 represents the "velocity difference," which is a term that needs some explanation. The velocity difference 0% indicates that the web and the roller have the same velocity. There is no mutual movement between the web and the roller surface contacting the web. If the rotation of the roller is retarded, the velocity difference increases. If the difference is 100%, the roller does not rotate at all. No coating liquid can, of course, be conveyed to the web. If the velocity difference is higher than 100%, the roller rotates in the opposite direction. At a difference of 200% the peripheral velocity of the roller is equal to the velocity of the web, but the roller rotates in the opposite direction.

The volume of coating liquid transferred to the paper web was measured in this example. The ordinate of the diagram of FIG. 6 represents this volume, defined as milliliters of liquid per $m^2$ of paper web.

It was found during the experiments of this example that a velocity difference close to 100%, say between 90 and 110%, resulted in very small quantities of coating liquid being transferred to the web, and being transferred in an irregular way. Therefore, the graphs in FIG. 6 have been drawn with broken lines in this zone. When the speed difference was lower than 90% a uniform coating of the web was obtained. If the vacuum is kept constant, the various graphs consist of straight lines in the area from 0% up to 80% velocity difference. It can be seen from FIG. 6 that, by varying the vacuum, it is possible to vary the amount of coating liquid transferred to the paper of the quality A from 4 to 12 milliliters per $m^2$ web surface. It can also be spelled out from FIG. 6 that the graph representing paper B has an inclination different to the other graphs. It is also interesting to note that the minimum quantity of coating liquid which could be transferred to the web with a satisfactory result was 4 ml/$m^2$ for both paper qualities. Another interesting effect, vide the graph A400, is that the coating is substantially greater at, for instance, 120% than at 80% velocity difference, although in both cases the same quantity of coating liquid is transported by the roller surface. The explanation is that the paper web wipes the roller better when the liquid is supplied on the side where the web leaves the roller.

The mentioned interval 4–12 ml/$m^2$ satisfactorily covers most requirements, especially as even a small quantity of coating liquid can be distributed uniformly also upon a web having a rough surface. Good uniformity with little coating can also be achieved for paper having high surface roughness. Said interval however, can be extended further by various expedients within the scope of the invention. For example, a roller can be used having on its surface a pattern of hollowed and protruding portions. A scraper can be used having a toothed edge. An undesired absorption of liquids by the paper can be counteracted by additives increasing the viscosity of the coating liquid, or by running the web at a higher speed or in a different direction. Materials other than paper can also be coated. Coating may also be performed on a continuously circulating endless belt which is then placed in contact with a moving web.

What is claimed is:

1. An apparatus for continuously coating a paper web with a liquid comprising a chamber having an opening in its wall; a roller mounted in said chamber having a portion of the surface of said roller situated in said opening and spaced from an edge of the opening in the wall of the chamber which is downstream from the roller; means for continuously passing a paper web past said chamber while covering said opening; means connected to the chamber for creating a vacuum in said chamber to suck the web into contact with the edges of said opening and said portion of the surface of the roller; means for supplying coating liquid into the chamber to wet the surface of the roller; and means for rotating the roller to convey coating liquid to the web, said means for rotating the roller being arranged to move the roller surface adjacent the web in the same direction as the motion of the web and at a speed which is up to that of the web, the vacuum in that portion of said chamber between the roller and the edge of the chamber downstream from the roller cooperating with the external atmospheric pressure to prevent substantial penetration of said liquid into the body of the web beyond the coated surface.

2. An apparatus as claimed in claim 1, in which the roller has a density below that of water.

* * * * *